United States Patent [19]

Newburger et al.

[11] 4,089,523

[45] May 16, 1978

[54] ALIGNING TOOL FOR STRINGS OF RACKET

[76] Inventors: Susan Newburger; John D. Keaney, both of R.F.D., Concord, Vt. 05824

[21] Appl. No.: 573,890

[22] Filed: May 5, 1975

[51] Int. Cl.[2] ..... A63B 69/38

[52] U.S. Cl. ..... 273/73 R

[58] Field of Search ..... 273/29 R, 29 A, 29 B, 273/73 R, 73 A, 73 B, 73 C, 73 D, 73 E, 74, 76, 132, 136 C, 136 E, 136 F, 153 S; 46/16, 25, 24; 99/372; 29/160; 269/40, 41; 172/378, 379; D7/87–89, 101; D34/5 SS

[56] References Cited

U.S. PATENT DOCUMENTS

| | | | |
|---|---|---|---|
| D. 24,343 | 5/1895 | McGonigle | D7/87 |
| D. 33,703 | 12/1900 | Whelen | D7/101 |
| D. 48,170 | 11/1915 | Colley | D7/101 |
| D. 57,334 | 3/1921 | Hanford | D7/101 |
| D. 174,913 | 6/1955 | Marcus | D7/101 |
| D. 235,894 | 7/1975 | DiLorenzo | D34/5 SS |
| 2,026,286 | 12/1935 | Samuels | 99/372 |
| 2,028,663 | 1/1936 | Harroff | 273/73 A |
| 2,936,697 | 5/1960 | Kueser | 99/372 X |

FOREIGN PATENT DOCUMENTS

| | | | |
|---|---|---|---|
| 332,487 | 8/1903 | France | 99/372 |
| 1,029,774 | 3/1953 | France | 273/76 |
| 278,019 | 1/1952 | Switzerland | 46/16 |
| 673,857 | 6/1952 | United Kingdom | 46/16 |

*Primary Examiner*—Richard J. Apley

*Attorney, Agent, or Firm*—Sughrue, Rothwell, Mion, Zinn and Macpeak

[57] ABSTRACT

An aligning tool for realigning misaligned strings in the central zone of the string network of a racket after heavy use to return the strings in a normal predetermined spacing, which tool includes a plurality of spaced right pyramidal projections extending from a base, the tool projections being adapted to be inserted between the strings to force misaligned strings of the racket back to a normal aligned condition.

13 Claims, 3 Drawing Figures

ALIGNING TOOL FOR STRINGS OF RACKET

FIELD OF THE INVENTION

This invention relates to an alignment tool for aligning the strings of a racket.

BACKGROUND OF THE INVENTION

As is perhaps well known when a tennis racket is used, for example in a tennis match, the central zone of the strings, sometimes referred to as the "sweet spot," becomes somewhat misaligned, because of the continual impact of a ball with the result that the tension of the strings is somewhat altered and a true hitting surface is altered, or, as is known among tennis players, made less "true." For this reason, in the time period between the several games of a tennis match, players in competition realign the strings manually with their thumbs to achieve an approximate realignment of the strings. This invention is of a tool with pyramidal projections which are equispaced and which are adapted to be inserted into the network of strings to quickly and accurately realign the central zone of the racket before the next game.

It is, accordingly, an object of this invention to provide a hand-held tool which can be used for quickly and accurately realigning the central zone of the racket strings which often become misaligned through use or, because of the affects of heat and jostling when it is stored or shipped. The tool is inexpensive to manufacture, is portable, and is adapted to be stored in a partially inserted condition in the racket while it is not in use.

In a preferred embodiment, the hand-held racket string aligning tool is adapted to be stored together with the racket with the projections extending into the network and with the projections and the overall tool size being storable in a conventional racket cover without interfering with the operation of a conventional racket press, which is used to clamp the outer surfaces of the racket rim together.

It is therefore, a general object of this invention to provide an aligning tool for serious tennis players to quickly and rapidly align the strings of a network to provide a true hitting surface, which can be readily stored when not in use, and which is portable.

In accordance with these and other objects of the invention which will become apparent hereinafter the instant invention will now be described with reference to the accompanying drawings in which:

DESCRIPTION OF THE PREFERRED EMBODIMENT

Figure 1:
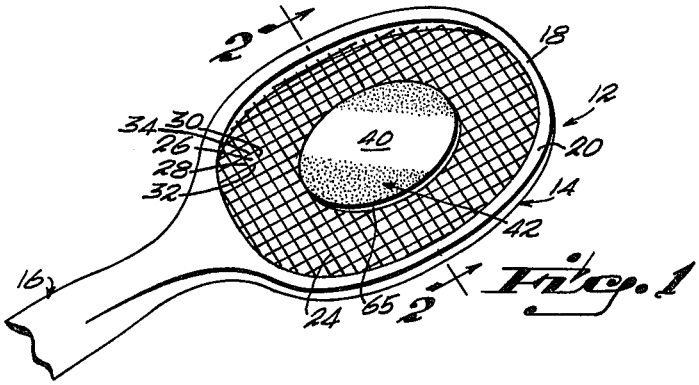
FIG. 1 is a perspective view of a racket with the aligning tool of the present invention in aligning engagement with the racket strings.

Referring to the drawings wherein like reference characters designate like or corresponding parts throughout the several views there is shown a stringed racket generally designated by the numeral 12 which includes a head portion 14 and a handle or stem 16. The head is bounded by a rim 18 having oppositely facing outer surfaces 20 and 22 each of which is generally planar. A network of strings 24 spans the rim in a central plane between the planar surfaces, see FIG. 2, defining a network of right angular rows and columns of open areas of a normal common size between opposing pairs of parallel strings such as that designated by the numeral 26 between the strings 28, 30, 32 and 34.

The tool, which is generally designated by the numeral 40, comprises a base 42 and a plurality of extending truncated four-sided right pyramidal projections such as that designated by the numeral 44 and which are preferably of a common size and shape and are arranged in a pattern, preferably in spaced rows and columns, as shown. The cross sectional areas of the terminal end of each projection, such as that designated by the numeral 46, is less than the normal open area 26 between opposing pairs of parallel strings of the network while the cross sectional area at the base 50 is at least as great as the normal open area 26. There is thus defined a transverse alignment plane in each projection of the tool which is designated by the numeral 54 in FIGS. 2 and 3 which is adjacent the base and, in the preferred embodiment illustrated is less than one-half the heighth of the respective projection between the base and terminal or distal end of the projection. In other words, the cross sectional area of the projection or teeth at the alignment plane is equal to the area of the normal size of open space between a pair of opposed parallel strings of a racket.

In a preferred embodiment, not shown, the projections may be next to one another on the base, i.e., not spaced apart, in which case the cross sectional area closely adjacent to the base of each projection is substantially equal to the open space between opposed pairs of parallel strings and the base contains the aligning planes at the juncture of the projections and the base.

Figure 2:
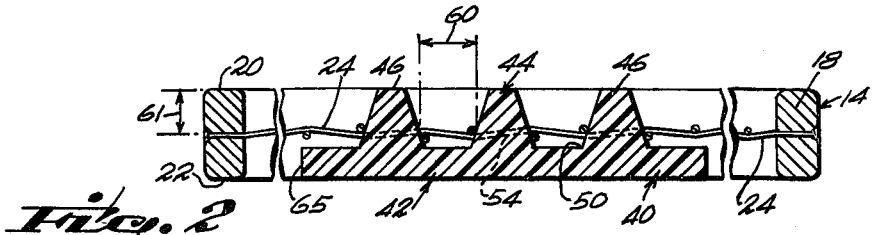
FIG. 2 is a cross sectional view taken along the line 2—2 of FIG. 1.
Figure 3:
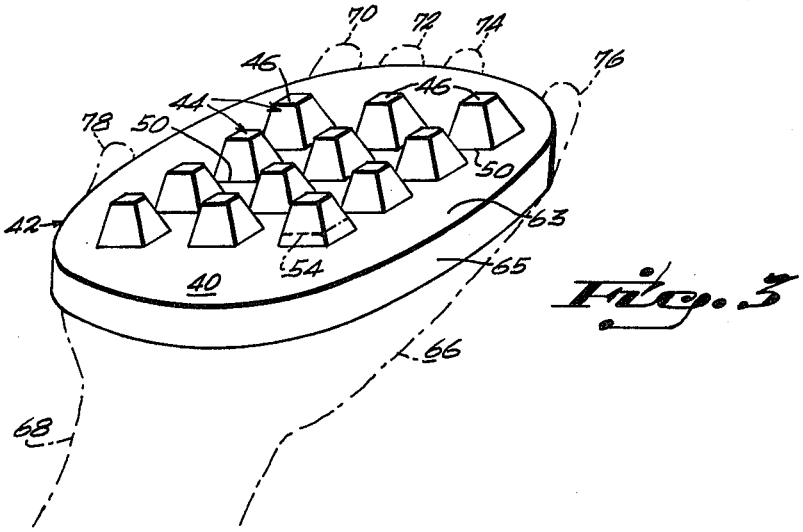
FIG. 3 is an enlarged perspective view of the aligning tool.

In the preferred embodiment shown in FIG. 2, the distance 60 between adjacent projection surfaces at the alignment plane level of the adjacent projections is equal to the distance between adjaent pairs of opposed parallel strings of the racket, i.e., the normal open space. This is so that the strings bounding alternate rows and columns of open spaces are adapted to be aligned and forced into equispaced relation when the projections of the tool are inserted and forced into the network of strings.

In the preferred embodiment, the lengths of the projections between their respective aligning planes and their respective terminal ends are equal, parallel and substantially the same in length as the distance between the central string network plane of the racket and the plane of the racket rim, as indicated by the numeral 61. This is so that, when the tool is inserted into the network and the racket is stored in a cover, the terminal ends of the projections are, generally, in a common plane with the outer rim surface 20 of the racket, when inserted as shown in FIG. 2. In such an embodiment, the base 42 includes a flat main surface 63 from which the projections extend in a common direction.

In either embodiment the base includes a peripheral gripping surface, designated by the numeral 65, which extends away from the projections. Preferably, the base is generally oval-shaped and sized to be held in the grip of a user between the base of the hand 66 adjacent the wrist zone 68 and the fingertips 70, 72, 74, and 76 and the thumb tip 78. Also, in the preferred embodiment, the number of projections in each row and in each column of the tool is at least three in number; and there are four projections in each row and three in each column. The sides and line of juncture of the adjacent aligning side surfaces of each projection are smoothed so as not to present sharp edges to the strings of the racket. In the preferred embodiment described the tool is of integral, molded construction and, preferably is of rigid plastic material.

What is claimed is:

1. In combination a string racket and string aligning tool therefor, said racket having a head bounded by a rim having oppositely facing generally planar surfaces and with a network of criss crossed strings arranged in a central plane between the rim surfaces which strings span the rim in a normal spaced relation with respect to one another defining parallel rows and right angularly arranged parallel defining columns of normal size open areas of common size between adjacent pairs of opposing parallel strings, said aligning tool comprising a device for realigning the strings in the central zone of the network to normal spaced relations after misalignment of them in use, said tool including:

a base with a plurality of extending truncated rigid four-sided right pyramidal projections of common size and shape arranged in rows and columns;

the cross sectional area of the terminal ends of each of said projections being less than the one of said normal size open areas between pairs of opposed parallel strings and the cross sectional area at the base of each projection being at least as great as said normal size open area defining a transverse aligning plane in each projection adjacent the base which is of an area equal to said area of one of said normal size open area between parallel strings, whereby the strings are adapted to be aligned and equispaced when the projections of the tool are inserted into the network, the base having a main surface with said projections extending therefrom and a peripheral gripping surface, said base being generally configured and sized to be held in the grip of a user between the base of the hand adjacent the wrist and the finger and thumb tips; and the number of projections in each row and in each column being at least three in number, the string engaging side surfaces of each of the projections being smooth and the juncture of the side surfaces of each projection being smooth so as not to present sharp edges to the strings of the racket.

2. The device as set forth in claim 1 wherein the projections are spaced from one another a distance such that that area between the aligning plane of adjacent teeth is equal to said normal size.

3. The device as set forth in claim 1 wherein said base and said projections are of integral construction and of rigid plastic material.

4. The device as set forth in claim 2 wherein said base and said projections are of integral construction and of rigid plastic material.

5. The device as set forth in claim 2 wherein the aligning plane of each projection is spaced from the main surface of the base a distance which is less than one-half the extending length of the projection.

6. The device as set forth in claim 1 wherein the aligning planes of each projection are in a common plane.

7. The device as set forth in claim 5 wherein the length of the projections between their respective aligning planes and their respective terminal ends is about equal to the distance from the central plane of the racket to one of the outer surfaces of the rim.

8. The device as set forth in claim 6 wherein said base and said projections are of integral construction and or rigid plastic material.

9. The device as set forth in claim 6 wherein the main surface is parallel to the common plane.

10. The device as set forth in claim 9 wherein the length of the projections between their respective aligning planes and their respective terminal ends is about equal to the distance from the central plane of the racket to one of the outer surfaces of the rim.

11. In combination, a strung racket and string aligning tool therefor, said racket having a head and a plurality of strings supported thereby, said strings being arranged into a number of substantially parallel main strings and a number of substantially parallel cross strings wherein said cross strings are transverse to said main strings to define a grid pattern of regularly spaced openings therebetween, said aligning tool including a base, a plurality of upstanding alignment fingers supported by said base, each of said alignment fingers has a horizontal profile corresponding to the opening formed by said strings, said alignment fingers being arranged according to said grid pattern and being spaced apart defining intersecting continuous slots to receive said strings therebetween, whereby displaced strings are urged to realignment to restore said grid pattern when said alignment device is forced into mesh with said strings.

12. The combination according to claim 11 wherein said base and said alignment fingers are of integral construction and of rigid plastic material.

13. The combination according to claim 11 wherein each of said alignment fingers is of a truncated four-sided right pyramid shape.

* * * * *